United States Patent [19]

Shibuta et al.

[11] Patent Number: 4,813,814

[45] Date of Patent: Mar. 21, 1989

[54] LEG-HOLDING DEVICE FOR OFFSHORE PLATFORM

[75] Inventors: Shigeto Shibuta, Yokohama; Masahiko Sakurai, Niihama, both of Japan

[73] Assignee: Sumitomo Heavy Industries, Ltd., Tokyo, Japan

[21] Appl. No.: 55,263

[22] Filed: May 29, 1987

[30] Foreign Application Priority Data

Aug. 7, 1986 [JP] Japan ..... 61-185662

[51] Int. Cl.[4] ..... E02B 17/08

[52] U.S. Cl. ..... 405/198; 254/95; 405/196

[58] Field of Search ..... 405/198, 196, 195; 254/105, 95, 106, 107, 112

[56] References Cited

U.S. PATENT DOCUMENTS

| | | | |
|---|---|---|---|
| 3,332,663 | 7/1967 | Cargile | 405/198 X |
| 3,411,750 | 11/1968 | Smulders | 405/198 X |
| 4,482,272 | 11/1984 | Colin | 405/198 |
| 4,521,134 | 6/1985 | Schoonmade | 405/198 |
| 4,589,799 | 5/1986 | Hotta et al. | 405/198 X |
| 4,627,768 | 12/1986 | Thomas et al. | 405/198 |

FOREIGN PATENT DOCUMENTS

| | | | |
|---|---|---|---|
| 83720 | 5/1983 | Japan | 405/196 |
| 98512 | 6/1983 | Japan | 405/196 |
| 59-86599 | 5/1984 | Japan . | |
| 60-188514 | 9/1985 | Japan . | |

*Primary Examiner*—Dennis L. Taylor

*Attorney, Agent, or Firm*—Armstrong, Nikaido, Marmelstein & Kubovcik

[57] ABSTRACT

An offshore platform provided with several supporting legs ascending and descending vertically and installed in a specified place on the sea by lowering the supporting legs onto the seabed after being towed to the specified place. Each of the supporting legs has on its side racks extending longitudinally. The supporting legs are lifted and lowered by driving pinions that engage with these racks. The offshore platform can be held immovably on the sea by fixing the meshing of the racks with the pinions, which is accomplished by braking pinion drives, when the supporting legs have reached the seabed. This offshore platform is also provided with stoppers that can engage with and disengage from the racks through the lateral movement thereof toward and away from the racks. The supporting legs are held by both the pinions and the stoppers. To ensure that the whole load applied to the pinions and stoppers are appropriately shared by both, a control device is installed which detects these two loads and automatically drives the pinions so as to set this ratio of loads to an appropriate value.

3 Claims, 4 Drawing Sheets

LEG-HOLDING DEVICE FOR OFFSHORE PLATFORM

BACKGROUND OF THE INVENTION

1. Field of the Invention

This invention relates to a leg-holding device for an offshore platform, especially for an oil drilling rig installed offshore.

2. Description of the Prior Art

An offshore platform is provided with several legs that ascend and descend vertically and is installed in a specified place on the sea by lowering the legs onto the seabed after it is towed to the specified place. To ensure a stable installation condition despite the effect of strong waves and under severe oceanic conditions, it is necessary that the legs lowered onto the seabed positively support not only the whole weight of the platform but also the environmental load. Usually, a leg is of a truss structure composed of three or four columns and each column has on its side racks which extend longitudinally. A lifting device having several pinions that mesh with these racks is mounted on the deck of the offshore platform. Each pinion is turned by means of a motor to lower the leg, and when all the legs have reached the seabed the deck is lifted along the legs. When the legs are positively secured on the seabed by the weight of the deck, the deck is immovably held against the legs by fixing the meshing of the racks with the pinions, which is accomplished by braking the motors. In a prior art apparatus, the lifting device also has the function of leg holding, a hydraulic cylinder is operatively connected to each motor, and the working chambers of the hydraulic cylinders are interconnected to make uniform the torques acting on respective pinions during leg holding, as disclosed in Japanese Patent Laid-Open No. 86599/84.

Under very severe environmental conditions, however, the leg-holding capability may be insufficient only through the leg-holding action of a lifting device. In another prior art apparatus, therefore, a leg-holding mechanism having stoppers that engage with racks aside from pinions is installed on the deck of an offshore platform, and this leg-holding mechanism performs the leg-holding function separately. Furthermore, in another example of this prior art apparatus, the leg-holding capability of the lifting device is also utilized and the leg-holding action is shared by the lifting device and the leg-holding mechanism, as disclosed in Japanese Patent Laid-Open No. 188514/85.

In the apparatus disclosed by Japanese Patent Laid-Open No. 188514/85, a large-capacity leg-holding mechanism is used for the sake of safety because no consideration is given to the proportions of load to be shared by the lifting device and leg-holding mechanism.

SUMMARY OF THE INVENTION

This invention is aimed at reducing the size of the apparatus by appropriately distributing loads applied to the lifting device and leg-holding mechanism and by making full use of the leg-holding capabilities of the two. In order to achieve this object, this invention provides a leg-holding device of an offshore platform comprising: a supporting leg which comprises at least one column provided with a rack extending longitudinally on its side and passes through a deck of the offshore platform; a lifting mechanism which is mounted on the deck and comprises at least one pinion engaging with the rack, a drive for causing the pinion to rotate reversibly, and means for braking the drive; and a leg-holding mechanism which is mounted on the deck and comprises at least one stopper adapted to move laterally toward and away from the column to engage with and disengage from the rack, wherein there is provided a control device for detecting loads applied to the stopper and the pinion and automatically operating the drive in accordance with detected loads so as to obtain a predetermined proportion of the two loads.

According to this invention, because automatic control is performed in a manner that the lifting mechanism and leg-holding mechanism always share appropriate loads corresponding to their respective capabilities, both the lifting mechanism and the leg-holding mechanism of required minimum capacity can be used and the equipment cost can be saved as a whole.

The above-mentioned object, operation and effect of the present invention will become clearer from the following description of a preferred embodiment with reference to the accompanying drawings:

DESCRIPTION OF THE PREFERRED EMBODIMENT

Figure 2:
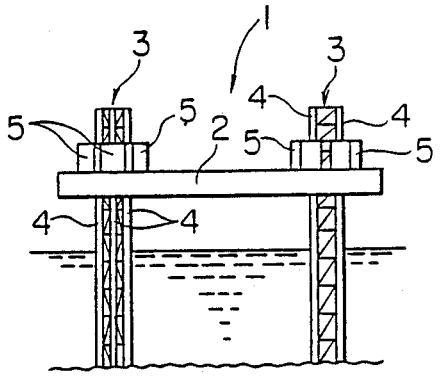
FIGS. 2 and 3 are the side view and top view, respectively, of an outline of an offshore platform to which the present invention is applied.
Figure 3:
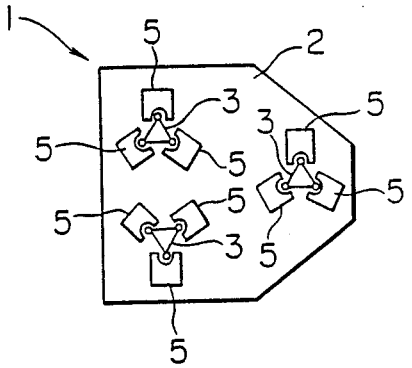

FIG. 2 and FIG. 3 are the side view and top view, respectively, of an outline of an offshore platform to which the present invention is applied. The offshore platform 1 is installed on the sea by placing on the seabed the bottom ends of several (three in the illustrated embodiment) supporting legs 3 that pass through a deck 2. Each of the supporting legs 3 is composed of three columns 4 to form a truss structure, and each column 4 is lifted and lowered by a lifting mechanism installed on a frame 5 erected on the deck 2, which will be described later. Incidentally, the number of columns 4 that compose the supporting leg 3 is not limited to 3 and four columns may be used as required.

Figure 1:
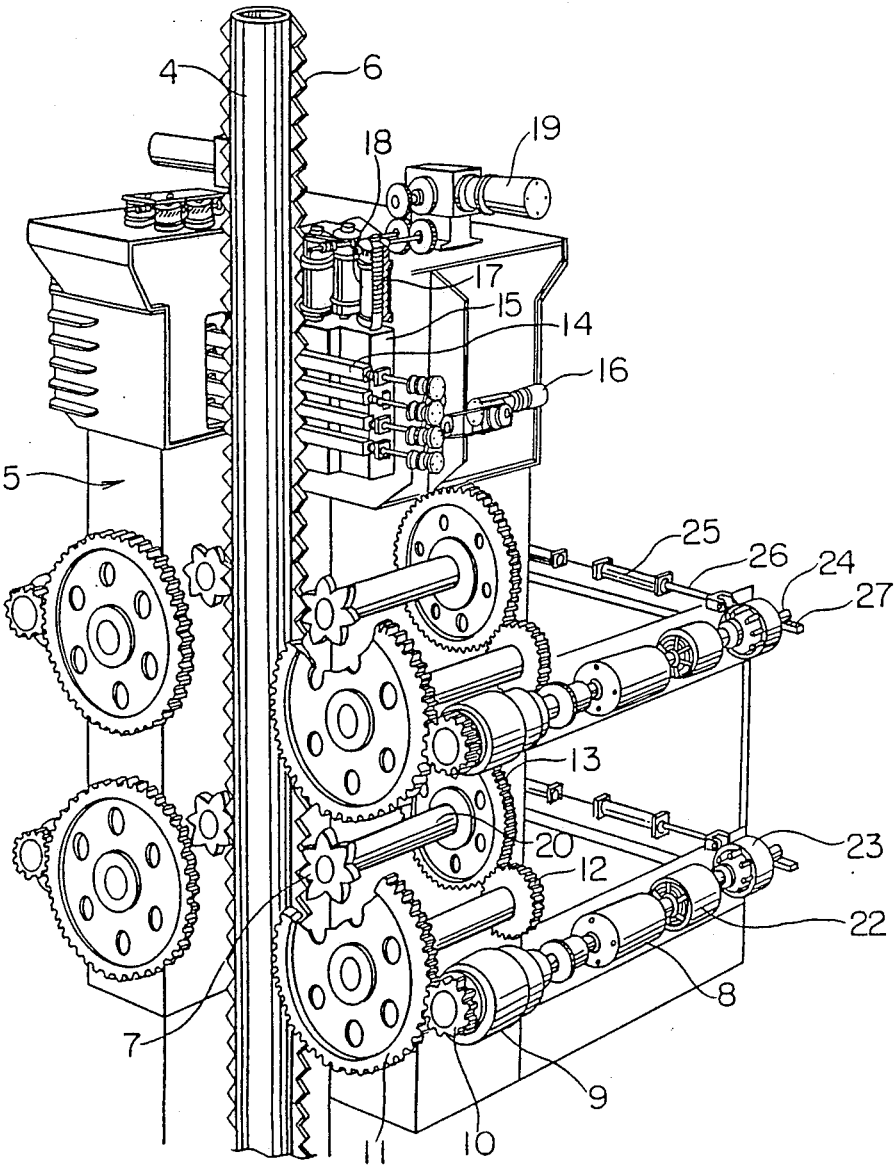
FIG. 1 is a partially broken perspective view of the whole of the lifting mechanism and leg-holding mechanism used as a leg-holding device of the present invention.

As shown in detail in FIG. 1, racks 6 extending longitudinally are formed on both sides of the column 4. The upper half of the frame 5 erected on the deck is provided with the leg-holding mechanism, and the lower half thereof with the lifting mechanism. The lifting mechanism has a total of four pinions that engage with the racks 6 on both sides of the column 4, and each pinion 7 is rotated via a gear 11, a gear 12, and a gear 13 by a gear 10 of a gear reducer 9 that is driven by a motor 8. The leg-holding mechanism has on each side a set of four stoppers 14 which are movable laterally with respect to the column 4 and adapted to engage with the rack 6. The stoppers 14 are slidably mounted on a casing 15 and are simultaneously moved toward the column 4 by a stopper-driving motor 16. The top end of each casing 15 is provided with three threaded lifting rods 17. Each lifting rod 17 is engaged with a sleeve 18 which is internally threaded and rotatably supported on top of the frame 5. The sleeve 18 is turned by a stopper-positioning motor 19 through a gear train to lift and lower the casing 15 via the lifting rod 17.

The lifting mechanism and leg-holding mechanism in accordance with the present invention are composed as described above. The column 4 is lowered onto the seabed by causing the motor 8 to drive the pinion 7 and then the motor 8 is braked to stop the pinion 7 when the deck has lifted to a desired level. By driving the stopper-positioning motor 19 the casing 15 is lifted or lowered and is stopped at a level where the stopper 14 will be able to mesh with the rack 6 correctly. After that, by driving the stopper-driving motor 16, the stopper is moved forward to engage with the rack 6 and the column 4 is fixed. As is apparent from the foregoing, the load on the deck 2 is shared and supported by the pinion 7 and stopper 14 that engage with the rack 6.

Figure 4:
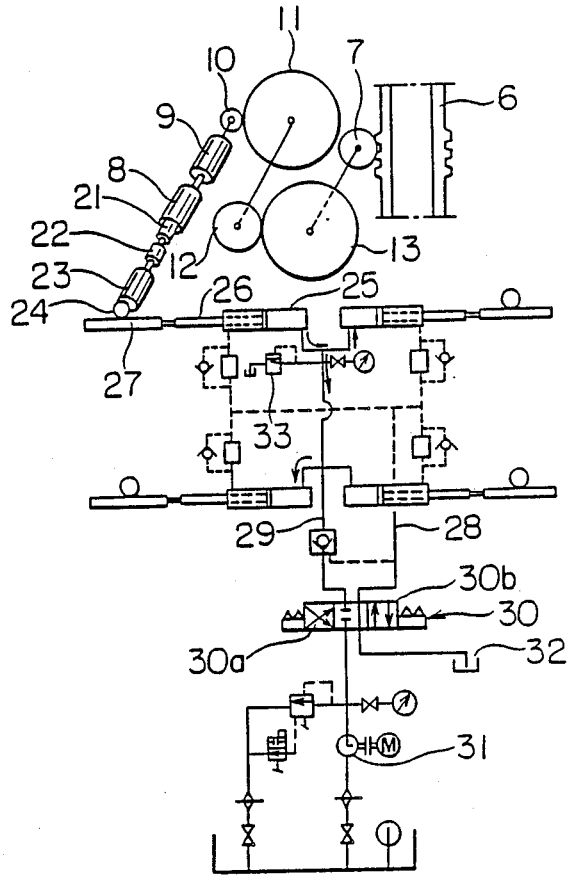
FIG. 4 is a schematic representation of an embodiment of a hydraulic circuit used in the present invention.

In this invention, to constantly control the sharing ration of this load to an appropriate value, the shaft 20 of pinion 7 and the lifting rod 17 of the casing 15 of stopper 14 are provided with strain gauges, which measure the load applied to the pinion 7 and that applied to stopper 14. A hydraulic system schematically shown in FIG. 4 is provided to turn the pinion 7 according to the ratio of these loads measured in order to increase or decrease the load applied to the pinion 7. The shaft of the pinion-driving motor 8 on the side opposite to the gear reducer 9 for driving the pinion 7 is connected to a planetary gear reducer 23 through an electromagnetic clutch 22, and the output shaft of the planetary gear reducer 23 is provided with a pinion 24 that engages with a rack 27, which performs linear motions in unison with a piston rod 26 of a hydraulic cylinder 25. Incidentally, the numeral 21 in FIG. 4 represents a braking device for the motor 21. The other three pinions 7 also have quite the same drives as mentioned above. In FIG. 4, however, these drives are omitted and only hydraulic cylinders ar shown. The hydraulic cylinders 25 are of the double acting type. The working chambers on the piston rod side of four hydraulic cylinders are interconnected by a common conduit 28. The working chamber on the other side are also interconnected by a common conduit 29. These working chambers on both sides are connected to a hydraulic pump 31 or a tank 32 depending on the working position of a solenoid operated directional control valve 30. A solenoid operated proportional pressure control valve 33 is provided in the other common conduit 29.

Figure 5:
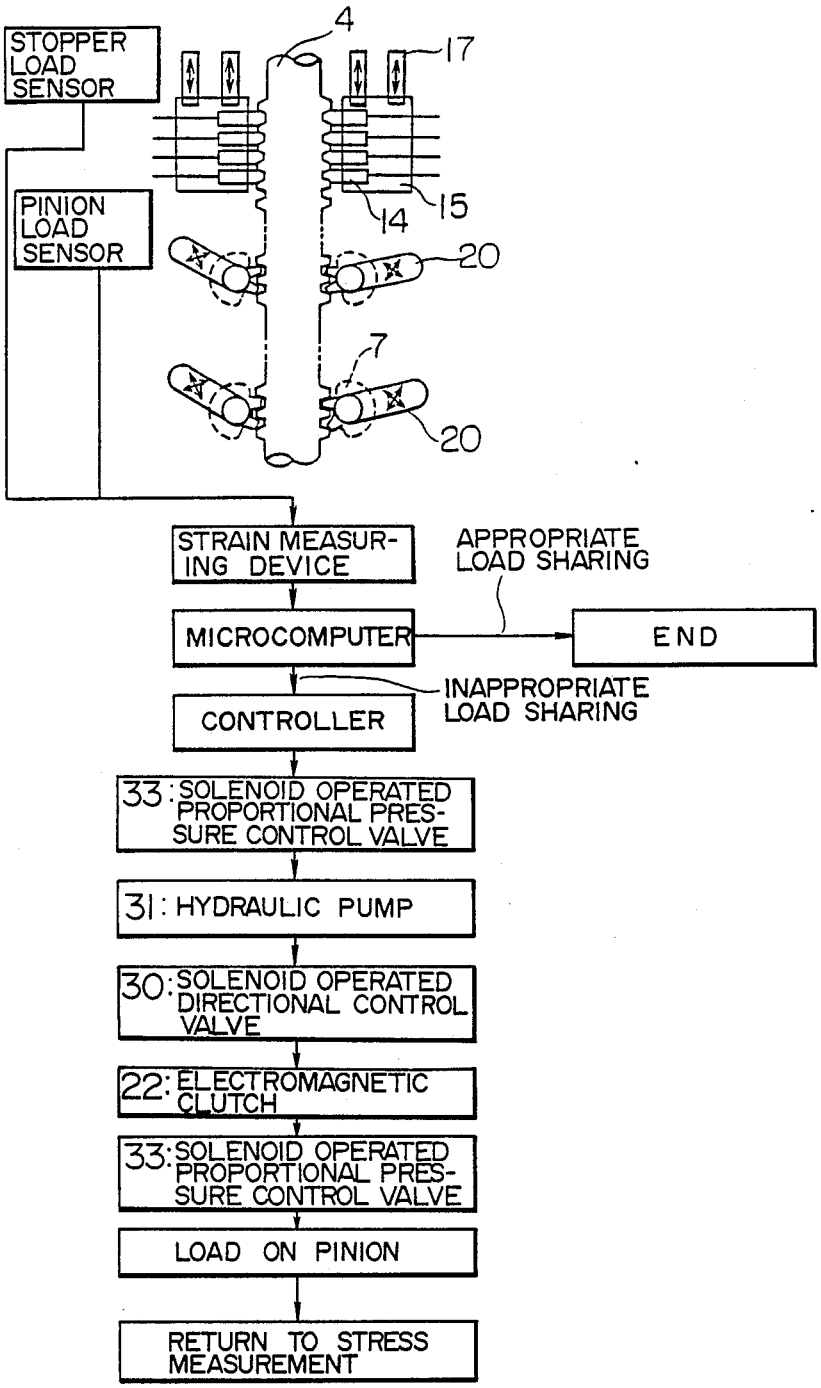
FIG. 5 is a flowchart illustrating the control process of the present invention.

FIG. 5 shows an outline of strain measurement and a flowchart showing the sequence of the load control in accordance with the present invention. In the figure, the double-headed arrows indicate strain gauges. When the deck 2 is installed on the sea, the load acting on the stopper 14 is measured as the compressive strain in the lifting rod 17 and the load acting on the pinion 7 is measured as the twisting strain in the shaft 20 of pinion 7. A microcomputer judges whether the proportions of these loads thus measured conform to an appropriate sharing ratio preset in the microcomputer. The appropriate sharing of load means that the load is shared by the group of stoppers and that of pinions at the proportions of load-holding capabilities of the two groups so that the load-holding capabilities of the two groups can display themselves most efficiently. When a model test was conducted in a case where eight stoppers and four pinions were used, for example, the maximum load held was each 650 tons for a single stopper and a single pinion. However, all of the stoppers and pinions do not share the load uniformly. Therefore, the total load held by each of the group of stoppers and the group of pinions was measured when the load held by one of stoppers or pinions in the two groups reached 650 tons and it was found that the total load held by the group of stoppers was 4,000 tons and that held by the group of pinions was 2,000 tons. In this case, therefore, an appropriate sharing ratio of the group of stoppers to that of pinions is 2:1. If the microcomputer judges that the load-sharing ratio of these two groups is appropriate, control for changing the ratio is not conducted or control is finished if control for changing the ratio is conducted. If the microcomputer judges that the load-sharing ratio is not appropriate, a command is issued to enable a controller to control the ratio.

The controller sets the setting pressure of the proportional pressure control valve 33 equivalent to the load applied to the pinion 7, drives the hydraulic pump 31, and sets the directional control valve 30 to any of the working positions. For example, if the load applied to the pinion 7 is too small as compared with the load applied to the stopper 14, the directional control valve 30 is set to 30·b and the proportional pressure control valve 33 sets a pressure for the working chamber opposite to the piston rod of the hydraulic cylinder 25 equivalent to the load applied to the pinion. Next, when the electromagnetic clutch 22 is energized to connect the planetary gear reducer 23 to the motor 8 and the brake 21 is released, the load applied on the pinion 7 is liable to cause the pinion 7 to turn anti-clockwise and move the piston of the hydraulic cylinder 25 in the direction in which the piston rod 26 is withdrawn. However, the movement of the piston is prevented by the pressure in the working chamber of cylinder on the side opposite to the piston rod, which is set equal to the load applied to the pinion. Next, the setting pressure of the proportional pressure control valve 33 is adjusted to a pressure equivalent to the load applied to the pinion calculated by the microcomputer so as to give an appropriate load-sharing ratio. The pressure in the working chamber of hydraulic cylinder on the side opposite to the piston rod thus exceeding the load applied on the pinion causes the piston rod 26 to the driven forward and causes the pinion 7 to turn clockwise in FIG. 4, thereby increasing the load on the pinion and reducing the share of the load applied to the stopper 14. If the load applied to the pinion 7 is too large as compared with the load applied to the stopper 14, the directional control valve 30 is set to 30*a* and the pinion 7 turns anticlockwise in FIG. 4 in order to reduce th load applied to the pinion. Therefore, the piston rod 26 is withdrawn and the oil in the working chamber of cylinder 25 on the side opposite to the piston rod is discharged through the proportional pressure control valve 33. This oil discharge continues until the load applied to the pinion decreases to a pressure corresponding to the appropriate load on the pinion set for the proportional pressure control valve 33, thereby increasing the load on the stopper relatively as a result of a decrease in the load applied to the pinion. Control is completed when an appropriate ratio is obtained by repeating the above-mentioned operation while detecting the load applied to the pinion and that applied on the stopper.

Incidentally, in the foregoing embodiment, a balance among torques applied to each pinion can be automatically established since each of the working chambers of hydraulic cylinders controlling each pinion is interconnected by means of the common conduits 28 and 29.

In this invention, the total load of the offshore platform is supported by the lifting mechanism and leg-holding mechanism. Furthermore, the load applied to the lifting mechanism and that applied to the leg-holding mechanism are constantly monitored, and control is conducted so that the ratio of two loads is constantly set to an appropriate value. Accordingly, the leg-holding capabilities of the two mechanisms can be utilized to the highest degree and as a result, it has become possible to reduce the size of the leg-holding device as a whole.

We claim:

1. A leg-holding device of an offshore platform comprising: a supporting leg having at least one column provided with a rack extending longitudinally on the side thereof and passing through a deck of the offshore platform; a lifting mechanism mounted on said deck and having at least one pinion engaging with said rack, a drive means for causing said pinion to rotate reversibly, and brake means for braking said drive means; a leg-holding mechanism mounted on said deck and having at least one stopper adapted to move toward and away from said column to engage with and disengage from said rack; first detection means for detecting load applied on said stopper; second detection means for detecting load applied on said pinion; and control means for adjusting an output of said drive means by comparing said loads in a manner such that the ratio of said loads is adjusted to a predetermined value.

2. A leg-holding device of an offshore platform as claimed in claim 1, wherein said control means comprises: a double-acting hydraulic cylinder provided with a piston operatively connected to said drive means; a hydraulic pump; a solenoid operated directional control valve adapted to work so as to connect first and second working chambers of said hydraulic cylinder to said hydraulic pump and a drain, respectively, and vice versa; and a solenoid operated proportional pressure control valve that communicates with one of the working chambers of said hydraulic cylinder and controls the pressure in this working chamber to an appropriate value corresponding to the load applied to said pinion and the load applied to said stopper.

3. A leg-holding device of an offshore platform as claimed in claim 2, wherein there are a plurality of said driving means, said pinions and said hydraulic cylinders, and further wherein each driving means drives each corresponding pinion, each hydraulic cylinder drives each corresponding drive means, and all of said first chambers of said hydraulic cylinders are connected to one another and all of said second chambers of said hydraulic cylinders are connected to one another.

* * * * *